United States Patent [19]

Dennison

[11] Patent Number: 4,471,181

[45] Date of Patent: Sep. 11, 1984

[54] ELECTRIC SWITCH WITH CLEANING ACTION

[75] Inventor: John J. Dennison, Southington, Conn.

[73] Assignee: Cooper Industries, Inc., Houston, Tex.

[21] Appl. No.: 448,727

[22] Filed: Dec. 10, 1982

[51] Int. Cl.[3] ..... H01H 5/06; H01H 1/18

[52] U.S. Cl. ..... 200/68.3; 200/241

[58] Field of Search ..... 200/241, 242, 68.3, 200/676, 68

[56] References Cited

U.S. PATENT DOCUMENTS

| | | | |
|---|---|---|---|
| 2,416,358 | 2/1947 | Stilwell | 200/241 |
| 3,424,882 | 1/1969 | Stokes | 200/68 |
| 3,439,138 | 4/1969 | Braun | 200/68 |
| 3,596,022 | 7/1971 | Gaber | 200/676 |
| 3,852,557 | 12/1974 | Brown | 200/241 |
| 3,858,021 | 12/1974 | Brandlein | 200/242 |
| 4,147,908 | 4/1979 | Swann | 200/676 |
| 4,170,725 | 10/1979 | Farrell | 200/676 |
| 4,190,750 | 2/1980 | Piber | 200/67 AA |
| 4,221,941 | 9/1980 | Genovese | 200/67 A |

*Primary Examiner*—John W. Shepperd

*Attorney, Agent, or Firm*—Wigman & Cohen

[57] ABSTRACT

A toggle type electric switch includes a first centrally mounted electrical terminal positioned to support a roller member, which defines a translatable pivot axis of an essentially elongate bridging contact which rides on the roller member. A spring loaded plunger-toggle mechanism cooperates with the roller member to define a over-center switching mechanism whereby the bridging contact may selectively engage and disengage a second fixed terminal to establish electrical contact therewith. The effect of the spring loaded plunger member operates to retain the roller member in one position during make of the switch components and shift the roller member for the break of the switch components. In this manner, the make and break surfaces of the mating switch components are different. Therefore, the electric arc contamination that builds up during the component break does not contaminate the surfaces of the switch components that engage during the make cycle, leaving the make surfaces of the components free of arc contamination, corrosion, or other foreign matter. Immediately following the make, the bridging contact member slides along the engaging terminal surface to wipe the mating surfaces clean of any contamination that has occurred since last being wiped clean during the previous make cycle.

15 Claims, 5 Drawing Figures

10
12
14
16
18
20
22
24
30
36
38
40
42
43
44
45
46
47
48
49
50
51
52
54
56
60
62
64
66
68

10
12
14
16
18
20
22
24
26
28
30
32
34
36
38
40
42
43
44
45
46
47
48
49
50
51
52
54
56
58
60
62

ELECTRIC SWITCH WITH CLEANING ACTION

BACKGROUND OF THE INVENTION

1. Field of the Invention

The present invention relates generally to electric switches having two or more stationary terminals and one or more movable bridging contacts adapted to be shifted into position to bridge the electrical connection between the stationary terminals, and more specifically to an electric switch of this type having a bridging contact that pivots about a roller element which is shiftable into two positions to enable the bridging contact to make electrical contact with a surface that is both different from the break surface of the fixed terminals and is not in the path of the bridging contact as the bridging contact slides along the break surface in order to avoid the problem of effecting the electrical make on top of contamination that has formed on the break surface thereof.

2. Description of the Prior Art

Toggle type switches in which an elongated bridging contact is positioned to be supported by, and rocked about, a central fixed terminal so that an end of the bridging contact can be shifted into engagement with a flat surface of a second fixed terminal, are in common use today. These switches commonly have a single fixed central terminal having a flat top surface thereof defining a fulcrum pivot point. The elongate bridging contact rides on this pivot point surface, and is adapted to rock upon this pivot point in order to selectively bridge the electrical contact between the two fixed terminals. The bridging contact is actuated by a spring loaded insulating plunger which is carried by the shank portion of a toggle mechanism, defining a bi-stable, over-center switching mechanism.

To shift the switching mechanism from one of its stable positions to the other stable position, the toggle element is moved, causing the elongate bridging contact to slide over the central terminal fulcrum point, compressing the insulating plunger up into the toggle shank. As the center line of the toggle and plunger mechanism crosses over the center line axis of the central terminal, the bridging contact is shifted away from the fixed terminal, effecting the contact break. In the reverse operation, the elongate bridging contact again rides over the center line axis of the central fixed terminal until the insulating plunger crosses over center, causing the bridging contact to snap back into electrical engagement with the fixed terminal.

The type of customary toggle switch described hereinabove utilizes a switching mechanism that causes the bridging contact and the stationary terminal to always make and break on the same surfaces. When the electrical contact is made and broken in this type of switch, an electric arc is generated between the two breaking contact elements, thereby depositing electrical contamination on each of these contact surfaces. After repeated breaks of the electrical contacts, this contamination has built up to such a degree that further positive make and break actions are made across these areas of contamination, rather than the initially smooth terminal surfaces, thereby resulting in extremely highly concentrated areas of current transfer across the build-up of contamination, further compounding the problem and contributing to the build-up of additional arcing contamination on each of these contact surfaces. This problem is, of course, greatly accelerated when the switch is used in high current applications.

SUMMARY OF THE INVENTION

According to the invention, an electric switch contains a central fixed terminal, and at least one other fixed terminal mounted within the switch housing. The central terminal has positioned thereon a conductive roller element which is constrained to limited lateral movement thereon. An elongate bridging contact rests upon the roller element and is adapted to pivot thereon to selectively engage and disengage the second fixed terminal to control the electrical connection through the switch. An over-center, bi-stable switching mechanism shifts the elongate bridging contact from its resting position establishing contact between the central and second fixed terminals via the conductive roller element, and a position wherein the bridging element does not contact the second fixed terminal. The conductive roller member is in one position during the "make" of the switch components, and is in a different position during the "break" of the switch components, so that the bridging contact makes and breaks with the second fixed terminal at different locations on the second fixed terminal. Following the make, the bridging contact slides along the second fixed terminal in order to wipe the mating surfaces clean of any contamination that may be present thereon. During the break cycle, and specifically immediately prior to the actual contact break, the bridging contact wipes across and cleans the make surface, and continues over and away from the make surface before actual contact break is effected.

BRIEF DESCRIPTION OF THE DRAWINGS

For a detailed description of the preferred embodiment of the invention, reference is made to accompanying drawings, in which.

DETAILED DESCRIPTION OF THE INVENTION

Figure 1:
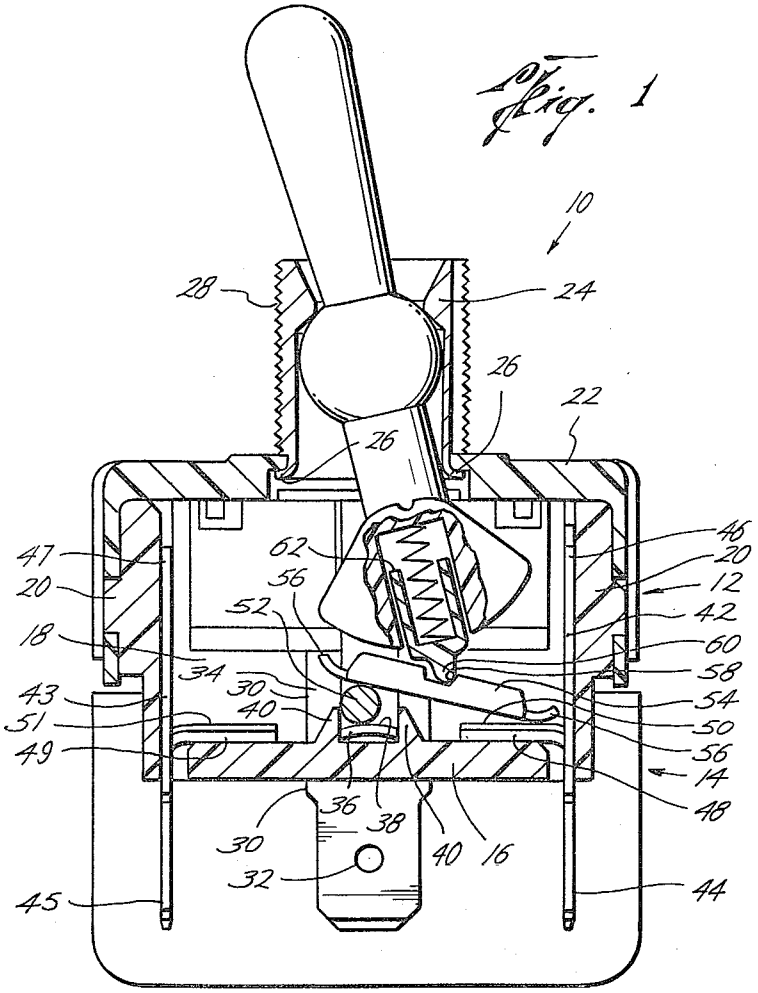
FIG. 1 is a side vertical sectional view of the electric switch of the present invention, showing the bridging contact in its rightmost hold position.
Figure 5:
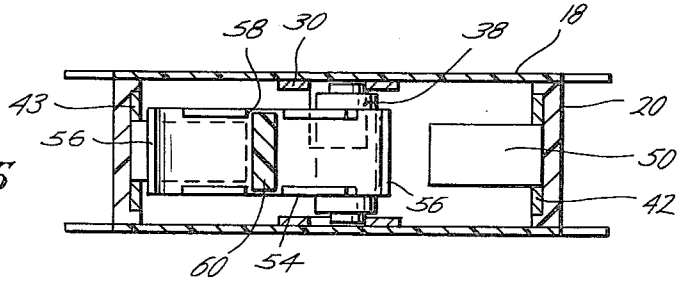
FIG. 5 is a horizontal sectional view of the electric switch of the present invention, taken along lines 5—5 of FIG. 4, showing the plan relationship of the components of the electric switch.

Turning now to the drawings, and more specifically to FIG. 1, the electrical switch of the present invention is shown in vertical section, generally illustrated by the numeral 10. The electrical components of the electrical switch 10 are enclosed within a housing 12 in a manner customarily known to those skilled in the art. In the embodiment of the switch 10 as shown, the housing 12 comprises a main body section 14, generally formed of plastic or other relatively inexpensive insulating material. The main body section 14 includes a base 16, side walls 18 (see also FIG. 5) and end walls 20, forming an open-topped box-like enclosure. After the electrical components are positioned within the box-like main body section 14, a top cover 22 is positioned over the opening of the main body section and affixed there in place in a customary manner, as by locking tabs that snap into mating grooves or recesses formed in the main body section 14. A mounting frame 24 is affixed to the housing top cover 22 in a customary manner prior to affixing the top cover to the main body section forming the housing, typically by a plurality of spring tabs 26 around the periphery thereof. Commonly this mounting frame is threaded externally at 28 to accept mounting nuts (not shown).

In the preferred embodiment, the top cover 22 and the mounting frame 24 are constructed of a high strength plastic material and may be easily snapped into place during assembly. Alternatively, these parts may be constructed of metal for greater structural integrity and retained in place by a series of cooperating bend tabs in the customary manner. In the instance when a metal top cover 22 and/or mounting frame 24 are used, an electrical insulator (not shown) would be positioned on the immediate inside of the top cover 22 in order to eliminate the possibility of the internal electrical components "shorting" to the top cover.

A central fixed terminal 30 is mounted in the main body base section 16, being either formed therewith when the housing is molded or press-fitted into the molded housing. The central fixed terminal 30 includes a wire connecting section 32 for typical solder, screw or quick connect/disconnect type connections, and an optional upper leg 34, commonly formed in the same plane as the wire connecting section.

As shown in the drawings, the central fixed terminal 30 includes a contact section 36, extending perpendicularly from the plane of the wire connecting section and upper leg 32, 34, defining an upward facing contact surface 38. In the preferred embodiment, this central fixed terminal contact surface 38 takes a convex form, defining the arc of a cylinder having an axis normal to the plane of the wire connecting section and upper leg 32, 34. This contact section 36 is commonly formed by punching out and bending down a section of the initially flat terminal. As will be explained in greater detail hereinbelow, the resulting through slot formed in the terminal 30 defines the limits of movement of the pivot axis of the bridging contact 54. Opposing bosses 40 are formed with the housing main body base for retaining the central fixed terminal contact section 36 in functional position as shown. As shown, the opposing surfaces of these bosses 40 are in alignment with the sides of the through slot formed in the terminal, to cooperate therewith to limit lateral movement of the bridging contact pivot axis.

Referring to any of FIGS. 1–4, the electric switch of the present invention also includes right and left side fixed terminals 42, 43, mounted in respective housing main body end walls 20 in a manner similar to that of the central fixed terminal 30. Like the central fixed terminal 30, each right and left side fixed terminal 40, 43 includes a wire connecting section 44, 45, upper legs 46, 47 and contact sections 48, 49 defining upper contact surfaces 50, 51. As shown, the right and left side fixed terminals 42, 43 are identical in structure and identical in operation. Therefore, for purposes of explanation of the invention herein, only the right side fixed terminal 42 will be discussed, it being understood that such discussion and explanation will likewise apply to the corresponding left side terminal 43.

As shown in the drawings, a roller element 52 is positioned on top of the central fixed terminal contact surface 38 in a manner to roll thereon and be constrained to limited lateral movement by the two opposing bosses 40 formed with the housing main body base 16 and by the opening of the through slot formed in the central terminal. This roller element 52 is made of a conducting material, preferably copper for a rigid, semi-hard conducting element.

As shown in the drawings, a bridging contact member 54 is positioned upon the roller element 52 in a manner to pivot thereon and selectively establish electrical contact between the central fixed terminal 30 and either the right or left side fixed terminal 42, 43. As shown, the bridging contact 54 is basically elongate in shape, having the respective ends thereof turned up slightly to define skids 56 for mating with respective right and left side fixed terminal contact surfaces 50, 51. The bridging contact member 54 also includes a cutout 58, centrally located on the top surface thereof for receiving the tip portion 60 of the toggle switch plunger 62.

As noted above, the side fixed terminals 42, 43 are identical in structure to the central fixed terminal 30, each upward facing contact surface 50, 51 being convex shaped, defining a cylindrical arc. In this manner, the bridging contact 54 rides on the apex of the arc and is assured of making complete electrical contact across the entire length of the roller element 52. The toggle switch plunger member 62 is spring mounted at 64 within a housing 66 defined by the toggle mechanism 68 in the customary manner to comprise an over-center, bi-stable, toggle type switching mechanism. This over-center mechanism, in combination with the shiftable roller member, essentially eliminates any teasing tendency in the present switch by assuring that the roller member axis snaps to the opposite side simultaneously with the plunger member crossing over-center. The tip portion 60 of the toggle switch plunger 62 has a semicircular cross-section to facilitate the plunger's cooperating with the bridging contact member cutout 58 to shift the bridging contact 54 between its two operating positions.

OPERATION

The switch depicted in the drawings is single pole double throw toggle type. Those skilled in the art will readily understand that the switching mechanism of the electrical switch of the present invention operates in exactly the same manner in making electrical contact with the left side and right side fixed terminals, as well as with any number of poles in a multiple pole switch.

With reference to the operation of the right side of the switch, the position shown in FIG. 1 is the stable "on" position. In this position, the toggle mechanism is in its counterclockwisemost position, with the plunger spring urging the plunger member downwardly against the bridging contact cutout, to hold the bridging contact in the rightmost position as shown. In this position, the plunger spring acting downwardly upon the roller element indirectly via the bridging contact urges the roller element to its leftmost position against the left side fixed central terminal boss, as shown.

Figure 2:
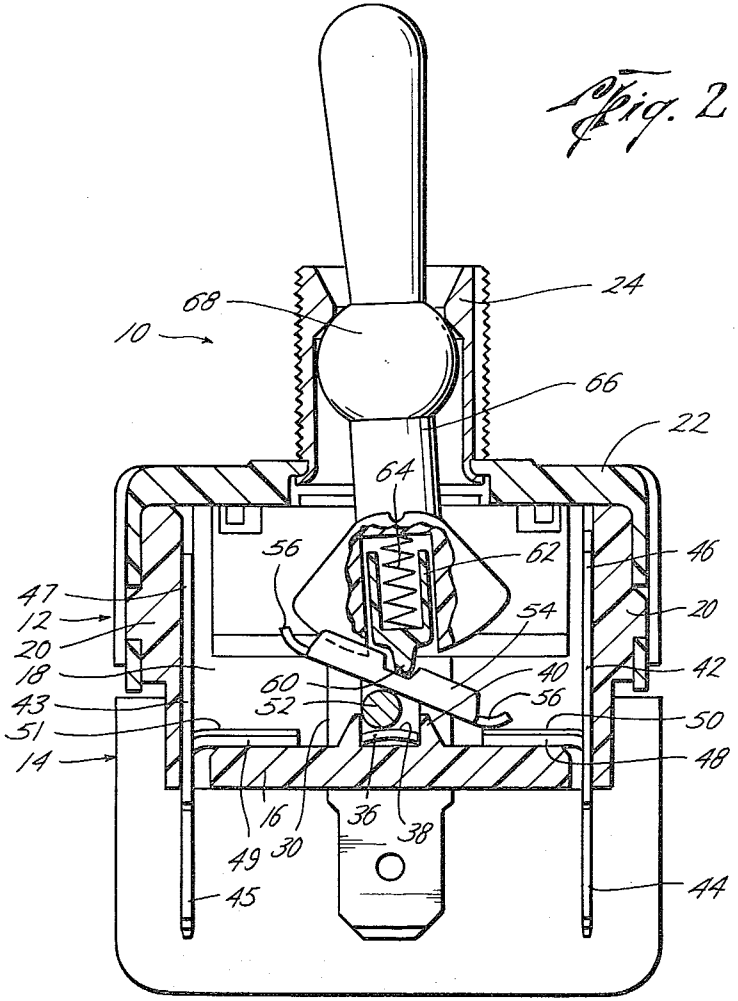
FIG. 2 is a view similar to FIG. 1, showing the relative position of the switch components in the break position as the toggle plunger approaches the center line of the bridging contact pivot axis.

As the toggle mechanism is rotated clockwise to the position shown in FIG. 2, the point of contact of the bridging contact and the right side terminal upper contact surface moves leftwardly along the right side terminal contact surface to a position adjacent the end thereof prior to the bridging contact being lifted from the right side fixed terminal contact surface. In this position shown in FIG. 2, the plunger member is being urged downwardly by the plunger spring along a line (essentially the center line axis of the toggle member) passing between the point of contact of the elongate bridging contact and the roller member, and the point of contact of the elongate bridging contact and the right side fixed terminal contact surface. Therefore, the force acting on the bridging contact retains the contact in electrical contact with both the roller member and the right side fixed terminal.

As the toggle member crosses the dead center position thereof with respect to the switch housing, the center line of force of the plunger member acting on the bridging contact is yet to the right of the line of opposing force of the roller member acting on the underside of the bridging contact (see FIG. 2). As the line of force of the plunger acting on the bridging contact crosses over the axis of the roller member, a force moment is created about the roller member, causing the bridging contact to rapidly pivot in the counterclockwise direction to snap into engagement with the left side fixed terminal contact surface at the location shown in FIG. 3, and of course, breaking the electrical connection between the bridging contact and the right side fixed terminal contact surface at the location shown in FIG. 2, thereby depositing a small amount of electric arc contamination on both breaking surfaces at that location. It should be noted here that the make position of the bridging contact and the left side fixed terminal is approximately in the center of the terminal upper contact surface, whereas the break position of the bridging contact and the right side fixed terminal is along the leftmost edge. This is due to the fact that the electrical components break when the roller element is in its furthermost position from the respective fixed side terminal, and that the electrical components make when the roller element is in its nearest position to the respective fixed side terminal.

Figure 3:
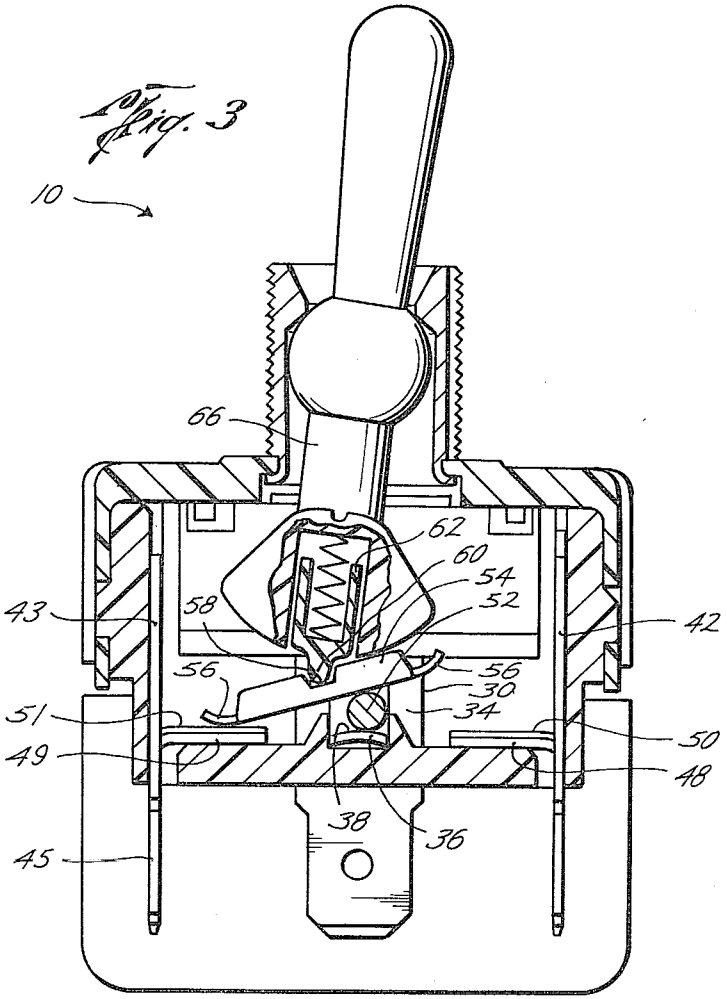
FIG. 3 is a view similar to FIGS. 1 and 2, showing the relative position of the switch components in the make position of the bridging contact and left side fixed terminal.

The inertia movement of the bridging contact from right to left, along with the inertia of the clockwise rotation of the toggle member relative to the housing, prevents the fixed contact from reversing direction relative to the roller member when the roller member is in its leftmost position, as shown in FIG. 2. Simultaneously therewith, as the line of force of the plunger spring acting via the plunger member against the bridging contact crosses over the center line axis of the pivot of the bridging contact (i.e. the roller member when the roller member is in its leftmost position), this force is transmitted through the bridging contact member to the roller member, causing a wedge effect of forces to snap the roller to the right as shown in FIG. 3. Since there is essentially no friction between the roller member and either the central fixed terminal contact surface or the bridging contact, this downward force created by the plunger spring retains the roller in its rightmost position as the bridging contact continues to slide to the left due to the combination of the toggle member inertia, the plunger spring expansion and the manual force switching the toggle member in a clockwise direction. This sliding movement of the bridging contact across the left fixed terminal causes the bridging contact to wipe along the upper surface of the left terminal contact surface to clean both surfaces free of any arc contamination that may have occured during the initial make of the contact surfaces.

Figure 4:
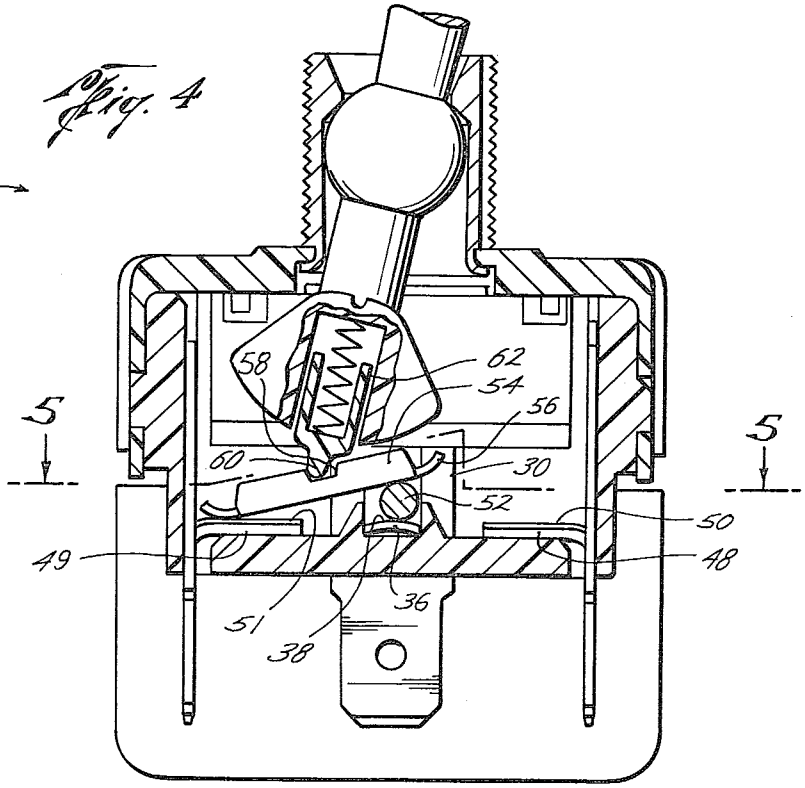
FIG. 4 is a view similar to FIGS. 1–3, showing the relative position of the switch components in the hold position of the bridging contact and the left said fixed terminal.

Finally, as shown in FIG. 4, the toggle member and bridging contact come to rest in the leftmost stable position establishing electrical contact between the central terminal and the left side terminal through the bridging contact and the roller member.

To shift the switching mechanism back to the position shown in FIG. 1, the above steps occur in the same sequence, the only difference being the movement of the switch components in opposite directions. Those skilled in the art will readily appreciate that because the bridging contact and the side terminals break at respective positions shown in FIG. 2, any electric arc contamination due to the break is deposited on the contact surfaces at those locations. When the two contacts make, they make at the location shown in FIG. 3, which of course, is remote from the break surfaces shown in FIG. 2. In this manner, the electric switch of the present invention always makes on surfaces that are contamination free, remote from the build-up of contamination on the break surfaces thereof. Additionally, any contamination that exists on the mating contact surfaces is wiped clean as the bridging contact slides across the mating surface of the side terminal from the initial make position shown in FIG. 3 to the stable hold position shown in FIG. 4. This extends the useful life of the metal electrical contacts by keeping the make surfaces thereof free of contamination and ensuring that the electrical contacts make on surfaces that are continually wiped free of electric arc contamination, corrosion, etc. Because of this, less expensive metals may be used for the terminal contacts, thereby decreasing the overall costs of the electric switch of the present invention.

Although particular embodiments of the invention have been illustrated in the accompanying drawings and description in the foregoing Detailed Description of the Invention, it will be understood that the invention is not limited to the embodiments disclosed, but is intended to embrace any alternatives, modifications, rearrangements and/or substitutions of elements as fall within the scope of the invention.

What is claimed is:

1. An electric switch, comprising;

(a) a housing;

(b) a central fixed terminal mounted within said housing;

(c) a second fixed terminal mounted within said housing;

(d) a bridging contact element movable between two stable positions within said housing for selectively electrically interconnecting said central and second fixed terminals; and (e) an over-center, bi-stable shifting mechanism for shifting said bridging contact element, said shifting mechanism comprising:

(1) contact pivot means defining a movable pivot axis, said contact pivot means being movably mounted with said central fixed terminal in a manner to support said bridging contact element in sliding relation to said contact pivot means and selectively shift the axis of rotation of said bridging contact element relative to said central fixed terminal; and (2) a switch device for switching said bridging contact element between said two stable positions.

2. The electric switch as set forth in claim 1, wherein said contact pivot means comprises a roller element having its axis of rotation transverse to the direction of movement of said bridging contact element, said roller element being constrained to limited lateral movement to limit the movement of the axis of rotation of said bridging contact element about said roller element relative to said central fixed terminal.

3. The electric switch as set forth in claim 2, wherein said bridging contact element is rigid and essentially elongate with a flat surface for engaging and sliding along said roller element.

4. The electric switch as set forth in claim 3, wherein said central fixed terminal includes a convex surface defining the arc of a cylinder, and wherein said roller element is positioned parallel to said cylinder arc and constrained to lateral movement thereagainst.

5. An electric switch, comprising:

(a) a housing;

(b) a central fixed terminal mounted within said housing, said terminal having a convex contact surface defining an arc of a cylinder;

(c) a second fixed terminal mounted within said housing;

(d) a conductive roller element positioned adjacent said central fixed terminal convex contact surface;

(e) a bridging contact movably mounted with said roller element for selectively establishing electrical contact between said central fixed terminal via said roller element and said second fixed terminal, said bridging contact cooperating with said roller element to define an axis of pivot of said bridging contact about said roller element that is shiftable relative to said central and second fixed terminals; and (f) an over-center, bi-stable switching mechanism for shifting said bridging contact into and out of engagement with said second fixed terminal.

6. An electric switch comprising:

(a) a housing;

(b) a central fixed terminal mounted within said housing;

(c) a second fixed terminal mounted within said housing;

(d) a contact pivot means comprising a roller element positioned adjacent to said central fixed terminal;

(e) a bridging contact element extending transversely to the axis of the roller element, said bridging element slidable with respect to the axis of said contact pivot means; and (f) an actuator element engaged with said bridging contact element for sliding said bridging contact element over said contact pivot means between two stable positions within said housing for selectively electrically interconnecting said central and second fixed terminals through said contact pivot means and said bridging contact element.

7. The electric switch as set forth in claim 6, wherein said roller element is cylindrical.

8. The electric switch as set forth in claim 7, wherein said housing comprises a base having opposing bosses thereon forming a groove between the bosses.

9. The electric switch as set forth in claim 8, wherein said roller element is positioned within the groove and is constrained to lateral movement between the bosses.

10. The electric switch as set forth in claim 6, further comprising:

(g) a third fixed terminal mounted within said housing;

wherein said bridging contact element makes an electric circuit between said central and second terminals in a first stable position and said bridging contact element makes an electric circuit between said central and third terminals in a second stable position.

11. An electric switch, comprising:

(a) a housing;

(b) a central fixed terminal mounted within said housing;

(c) a second fixed terminal mounted within said housing;

(d) a contact pivot means positioned adjacent said central fixed terminal;

(e) a bridging contact element movable between two stable positions within said housing for selectively electrically interconnecting said central and second fixed terminals, said bridging contact element being in sliding electrical contact with said contact pivot means;

(f) an actuator element, engaged with said bridging contact element for sliding said bridging contact element over said contact pivot means between two stable positions for selectively making an electric circuit between said central and second terminal through said bridging contact element and pivot means, such that when said bridging contact element is being slid to its stable position making the electric circuit between said terminals, the bridging contact element makes an initial electrical contact with a first portion of said second terminal and stabilizes in contact with a second portion of said second terminal.

12. The electric switch as set forth in claim 11, wherein said contact pivot means comprises a cylindrical roller element having its axis of rotation transverse to the direction of movement of said bridging contact element.

13. The electric switch as set forth in claim 12, wherein said bridging contact element is rigid and essentially elongate with a flat surface for engaging and sliding along said roller element.

14. The electric switch as set forth in claim 13, wherein said central fixed terminal includes a convex surface defining the arc of a cylinder, and wherein said roller element is positioned parallel to said cylinder arc and constrained to lateral movement thereagainst.

15. The electric switch as set forth in claim 11, further comprising:

(g) a third fixed terminal mounted within said housing;

wherein said bridging contact element makes an electric circuit between said central and second terminals in a first stable position and said bridging contact element makes an electric circuit between said central and third terminals in a second stable position.

* * * * *